US008038146B2

(12) United States Patent
Tsuji

(10) Patent No.: US 8,038,146 B2
(45) Date of Patent: Oct. 18, 2011

(54) POST-PROCESSING DEVICE AND IMAGE FORMING APPARATUS PROVIDED WITH THE SAME

(75) Inventor: Masaru Tsuji, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/708,624

(22) Filed: Feb. 19, 2010

(65) Prior Publication Data

US 2010/0225044 A1 Sep. 9, 2010

(30) Foreign Application Priority Data

Mar. 5, 2009 (JP) ..... 2009-051947

(51) Int. Cl.
*B65H 31/26* (2006.01)
*B65H 85/00* (2006.01)

(52) U.S. Cl. ..... 271/220; 271/3.03

(58) Field of Classification Search ..... 271/3.03, 271/207, 220; 270/58.07, 58.08, 58.11
See application file for complete search history.

(56) References Cited

U.S. PATENT DOCUMENTS 7,874,553 B2 * 1/2011 Kushida et al. ..... 270/58.27
2004/0207148 A1 * 10/2004 Murata et al. ..... 271/207
2006/0071411 A1 * 4/2006 Obuchi et al. ..... 271/207
2006/0202403 A1 9/2006 Nagata et al.
2007/0145674 A1 * 6/2007 Saito ..... 271/207

FOREIGN PATENT DOCUMENTS

JP 2003-300654 A 10/2003
JP 2006-248685 A 9/2006
JP 2007-084269 A 4/2007

* cited by examiner

*Primary Examiner* — Kaitlin Joerger
*Assistant Examiner* — Patrick Cicchino
(74) *Attorney, Agent, or Firm* — Renner, Otto, Boisselle & Sklar, LLP

(57) ABSTRACT

A post-processing device includes an introductory feed path, a processing tray, a post-processing section, a catch tray, a sheet delivery section, and a control section. The post-processing section is configured to perform post-processing on the sheet placed on the processing tray. The catch tray is disposed below the processing tray. The sheet delivery section has an upper rotary member and a lower rotary member which are disposed at an end of the processing tray lying on a catch tray side so as to be movable toward and away from each other. The control section causes the upper rotary member and the lower rotary member to press against each other at latest by the time a leading edge of a first sheet of a group of sheets to be post-processed at a time is brought into contact with the catch tray.

10 Claims, 12 Drawing Sheets

POST-PROCESSING DEVICE AND IMAGE FORMING APPARATUS PROVIDED WITH THE SAME

CROSS REFERENCE

This Nonprovisional application claims priority under 35 U.S.C. §119(a) on Patent Application No. 2009-051947 filed in Japan on Mar. 5, 2009, the entire contents of which are hereby incorporated by reference.

BACKGROUND OF THE INVENTION

The present invention relates to a post-processing device which is provided to a sheet processing apparatus configured to perform predetermined processing on a sheet and which is configured to perform post-processing on the sheet having been subjected to the predetermined processing at a sheet processing section of the sheet processing apparatus. The present invention also relates to an image forming apparatus provided with such a post-processing device.

DESCRIPTION OF THE RELATED ART

Among sheet processing apparatuses such as an image forming apparatus, there is one which is provided with a post-processing device configured to perform a binding process such as stapling, a punching process and an offset process.

Such a post-processing device usually includes: an introductory feed path for feeding a sheet introduced into the post-processing device from a sheet processing section such as an image forming section; a processing tray for placing thereon the sheet having passed through the introductory feed path; and a catch tray for receiving the sheet having been post-processed on the processing tray and delivered from the processing tray (see Japanese Patent Laid-Open Publication No. 2006-248685).

As shown in FIGS. 1A to 1C, such a post-processing device is typically configured to carry out a process including: feeding a sheet 80 to be subjected to post-processing by an introductory feed section 22 while separating an upper sheet feeding roller 229 and a lower sheet feeding roller 244 from each other until the trailing edge of the sheet 80 reaches the space between the upper sheet feeding roller 229 and the lower sheet feeding roller 244; and pressing the upper sheet feeding roller 229 against the lower sheet feeding roller 244 to draw the sheet 80 into a processing tray 24 after the trailing edge of the sheet 80 has reached the space between the upper and lower sheet feeding rollers 229 and 244.

With such a conventional post-processing device, however, a sheet feed failure sometimes occur due to the leading edge of the sheet 80 brought into contact with a catch tray 28 when the sheet 80 having passed through the introductory feed section 22 is drawn into the processing tray 24.

Specifically, in cases where the first sheet 80 of sheets to be subjected to post-processing at a time is curled down, the leading edge of the sheet 80 collides with the catch tray 28, so that the sheet 80 becomes rolled or curled on the catch tray 28, as shown in FIG. 2. This results in a problem that a paper jam occurs during sheet feeding or the sheet 80 cannot properly be drawn into the processing tray 24.

A feature of the present invention is to provide a post-processing device which is capable of preventing the occurrence of the sheet feed failure in the post-processing device due to a sheet curled even when such a curled sheet is introduced into the post-processing device. Another feature of the present invention is to provide an image forming apparatus provided with such a post-processing device.

SUMMARY OF THE INVENTION

A post-processing device according to the present invention is for use with a sheet processing apparatus configured to perform predetermined processing on a sheet, the post-processing device being configured to perform post-processing on the sheet having been subjected to the predetermined processing at a sheet processing section of the sheet processing apparatus. Representative examples of such sheet processing sections include an image forming section which performs image formation on a sheet. However, the sheet processing section is not limited to such an image forming section. The post-processing device includes an introductory feed path, a processing tray, a post-processing section, a catch tray, a sheet delivery section, and a control section.

The introductory feed path is configured to allow the sheet having been subjected to the predetermined processing at the sheet processing section to be introduced therein. The processing tray is disposed below the introductory feed path and configured to place thereon the sheet having passed through the introductory feed path. The post-processing section is configured to perform post-processing on the sheet placed on the processing tray. The catch tray is disposed below the processing tray and configured to receive the sheet delivered from the processing tray after the post-processing by the post-processing section.

The sheet delivery section has an upper rotary member and a lower rotary member which are disposed at an end of the processing tray lying on a catch tray side so as to be movable toward and away from each other. Representative examples of such upper and lower rotary members include upper and lower sheet feeding rollers. However, use may be made of an endless belt instead of such a roller.

The control section is configured to control at least operation of the sheet delivery section. The control section causes the upper rotary member and the lower rotary member to press against each other at latest by the time a leading edge of a first sheet of a group of sheets to be post-processed at a time is brought into contact with the catch tray. For example, the position of the leading edge of the sheet may be determined either by calculation using the result of detection by a sheet detection sensor disposed adjacent the inlet of the post-processing device and the sheet feeding speed or by detection of the position of the leading edge of the sheet by a sensor provided adjacent the sheet delivery section for detecting the leading edge of the sheet.

With the above-described construction, the leading edge side of the first sheet belonging to the group of sheets to be post-processed at a time is supported by the upper and lower sheet feeding rollers of the sheet delivery section before the leading edge of the sheet reaches the catch tray when the first sheet is drawn into the processing tray. Therefore, the sheet becomes less likely to contact the catch tray with its leading edge hung down. As a result, it is possible to prevent the occurrence of such an inconvenience that the sheet becomes rolled or curled due to its leading edge caught on the catch tray.

The above-described control over the sheet delivery section is performed only for the first sheet belonging to the group of sheets to be post-processed at a time. This is because the second sheet or any succeeding sheet that follows the second sheet is supported by the first sheet or the preceding sheet from below and, hence, the control according to the present invention need not necessarily be performed for the second sheet and the succeeding sheets, and because, when the control according to the present invention is performed for the second sheet and the succeeding sheets, contamination or stain, such as stain with toner, may occur due to rubbing of the sheets against each other.

The time at which the upper rotary member and the lower rotary member are brought into contact with each other has to be before the collision of the leading edge of the sheet with the catch tray at latest. More preferably, the time at which the upper rotary member and the lower rotary member are brought into contact with each other has to be after the passage of the leading edge of the sheet between the pair of sheet feeding rollers and before the collision of the leading edge of the sheet with the catch tray.

Preferably, a contrivance is provided to allow the leading edge of the sheet to be easily oriented upward when the first and second rotary members hold the first sheet therebetween. For example, preferable contrivances are: an arrangement wherein the upper rotary member is disposed in a deviated position in which the upper rotary member is located farther from the catch tray than the lower rotary member; an arrangement wherein the lower rotary member is formed from a softer material than the upper rotary member; and an arrangement wherein an endless belt is used as the lower rotary member.

Alternatively, projections each comprising an elastic member may be provided outside the upper and lower rotary members for raising the widthwise opposite ends of the sheet held between the upper and lower rotary members to impart the sheet with certain stiffness.

The foregoing and other features and attendant advantages of the present invention will become more apparent from the reading of the following detailed description of the invention in conjunction with the accompanying drawings.

DETAILED DESCRIPTION OF THE INVENTION

Figure 1A:
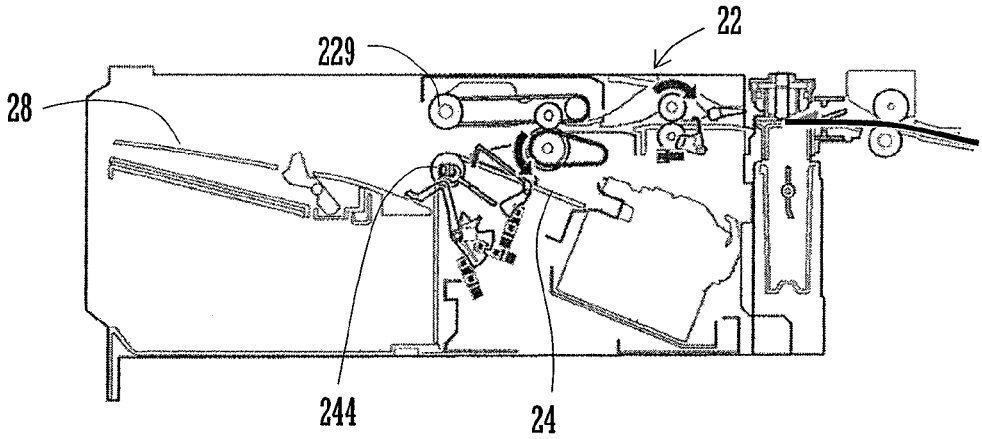
FIGS. 1A to 1C are views illustrating an exemplary sheet feeding procedure in a conventional post-processing device.
Figure 1B:
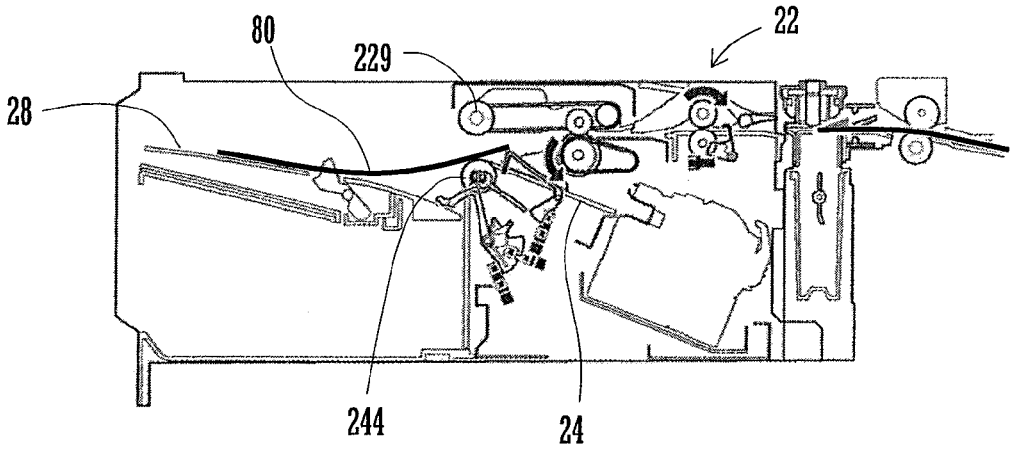
Figure 1C:
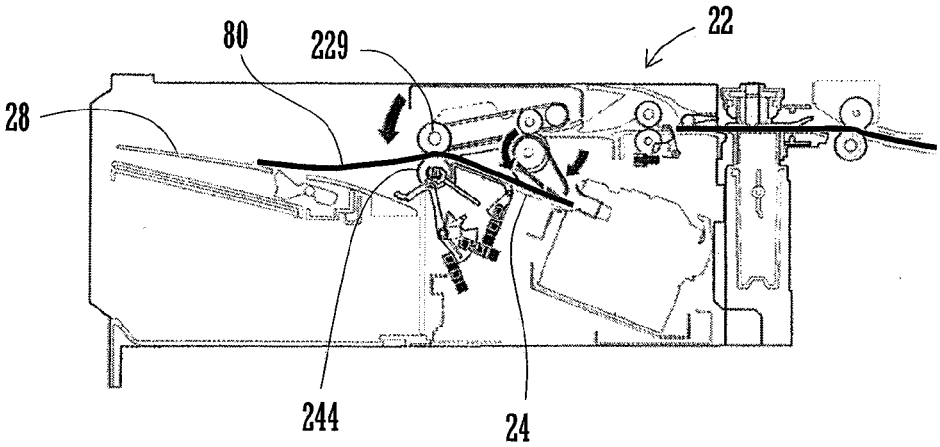
Figure 2:
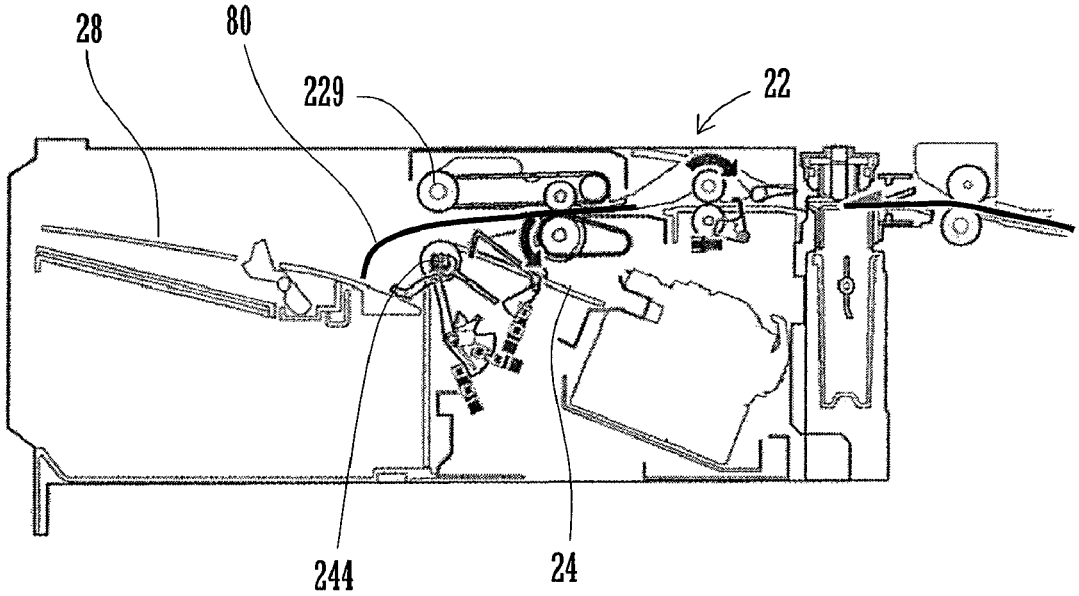
FIG. 2 is a view illustrating an exemplary sheet feeding procedure in a conventional post-processing device.
Figure 3:
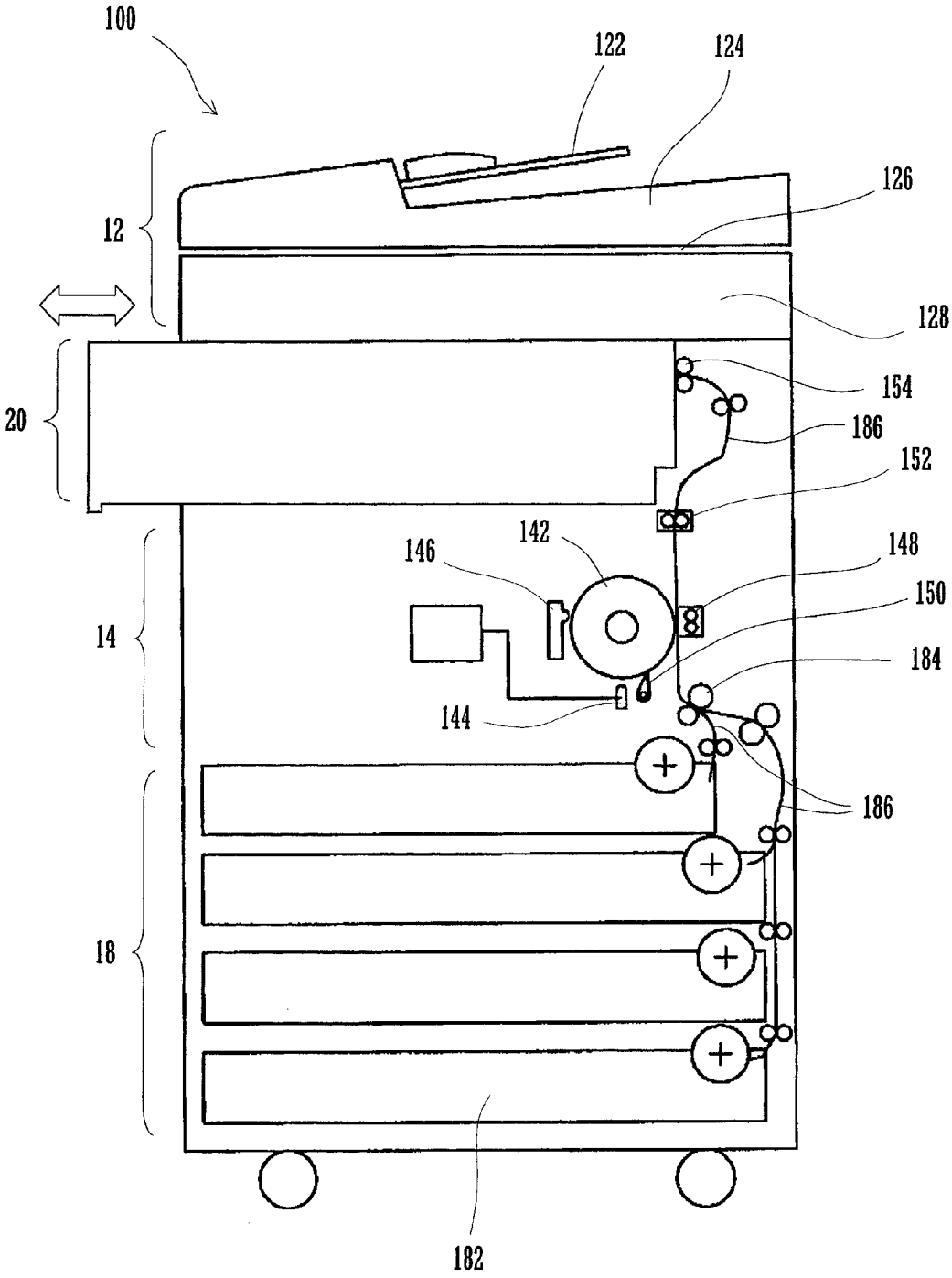
FIG. 3 is a view schematically illustrating an image forming apparatus according to an embodiment of the present invention.

FIG. 3 schematically illustrates an image forming apparatus 100 to which a post-processing device according to an embodiment of the present invention is applied. The image forming apparatus 100 includes an image reading section 12 which reads an image of a document to generate image data, an image forming section 14 configured to perform image formation on a sheet, a sheet feeding section 18 configured to feed sheets to the image forming section 14 sequentially, and a post-processing device 20 configured to perform post-processing on the sheet having been subjected to the image formation at the image forming section 14.

The image reading section 12 includes an optical system unit configured to read the image of the document on a platen 126, and an automatic document feeding section 124 configured to feed document sheets placed on a document rest 122 to a document reading position on the platen 126 sequentially.

The image forming section 14 includes a photosensitive drum 142 as an image carrier disposed so as to be in contact with a sheet feed path 186. Around the photosensitive drum 142, there are disposed an exposure device 144, a developing device 146, a transfer device 148, and a cleaning device 150. The exposure device 144 forms an electrostatic latent image on the photosensitive drum 142 by exposing the photosensitive drum 142 to light. The developing device 146 develops the electrostatic latent image on the photosensitive drum 142 by supplying a developer to the photosensitive drum 142. The transfer device 148 transfers the resulting developer image from the photosensitive drum 142 onto a sheet. The cleaning device 150 collects residual developer and the like remaining on the photosensitive drum 142.

The image forming section 14 further includes a fixing section 152 disposed on the sheet feed path 186 at a location downstream of the photosensitive drum 142. The fixing section 152 fixes the transferred developer image to the sheet by heat and pressure. Introduction rollers 154 which introduce each sheet having been subjected to the image formation into the post-processing device 20 are disposed on the sheet feed path 186 at a location downstream of the fixing section 152.

The sheet feeding section 18 includes a plurality of sheet container cassettes 182 each containing sheets therein. Each of the sheet container cassettes 182 is provided with a mechanism for paying out the sheets one by one into the sheet feed path 186. The sheet feeding section 18 further includes a pair of registration rollers 184 for adjusting the timing with which each sheet is fed to the image forming section 14.

Figure 4:
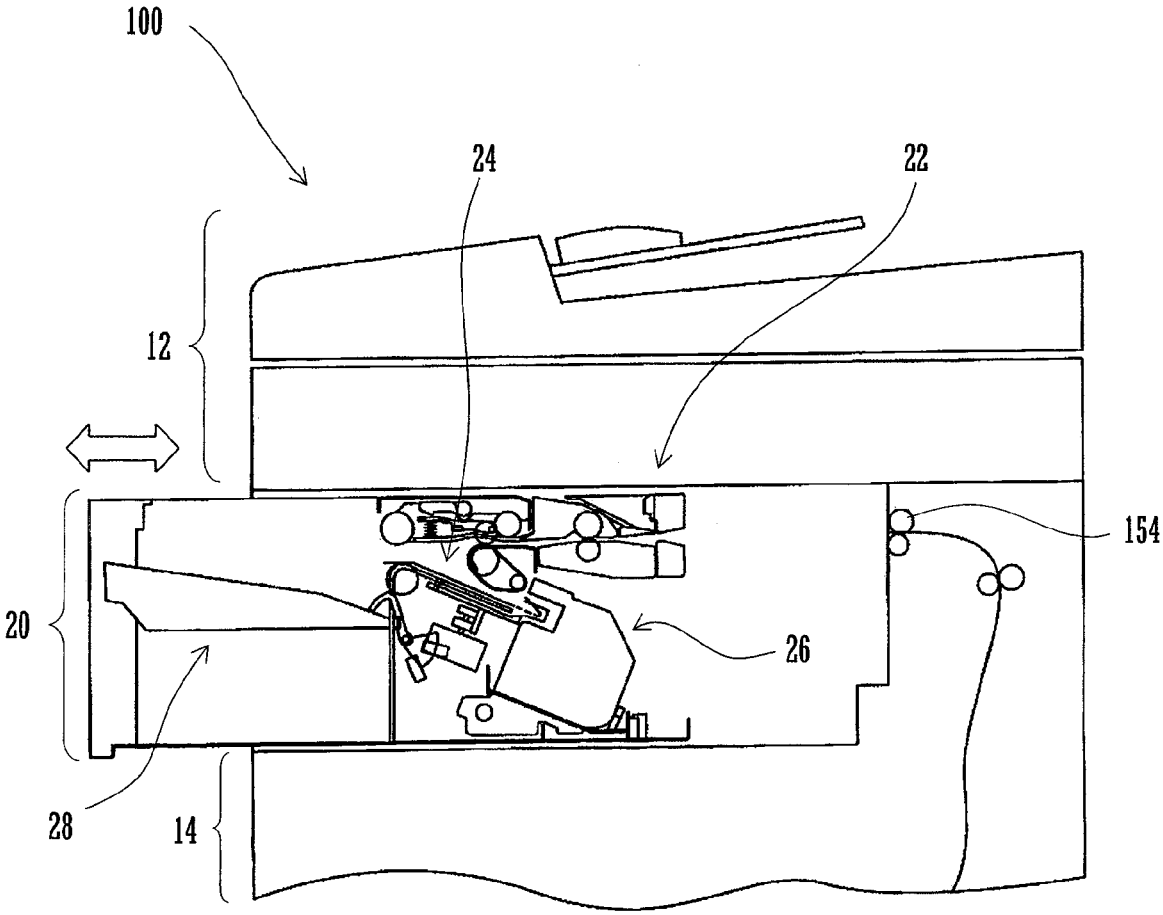
FIG. 4 is a view schematically illustrating the structure of a post-processing device.

FIG. 4 is a view schematically illustrating the post-processing device 20. The post-processing device 20 is designed so as to be attachable to or removable from the image forming apparatus 100. FIGS. 3 and 4 show the post-processing device 20 in a state of being drawn outwardly of the image forming apparatus 100. When fitted in the image forming apparatus 100, the post-processing device 20 is placed between the image reading section 12 and the image forming section 14.

The post-processing device 20 includes an introductory feed section 22, a processing tray 24, a post-processing section 26, and a catch tray 28. The introductory feed section 22 feeds the sheet that has been introduced into the post-processing device 20 by the introduction rollers 154 into the processing tray 24. When the post-processing device 20 is properly fitted into the image forming apparatus 100, the introductory feed section 22 is connected to the sheet feed path 186. The processing tray 24 is configured to temporarily accommodate therein a stack of sheets to be processed by the post-processing section 26. The post-processing section 26 is configured to perform binding of the sheets placed on the processing tray 24 by stapling or the like, or punching of the sheets. The catch tray 28 is configured to receive the sheets that are delivered after having been post-processed by the post-processing section 26.

Figure 5:
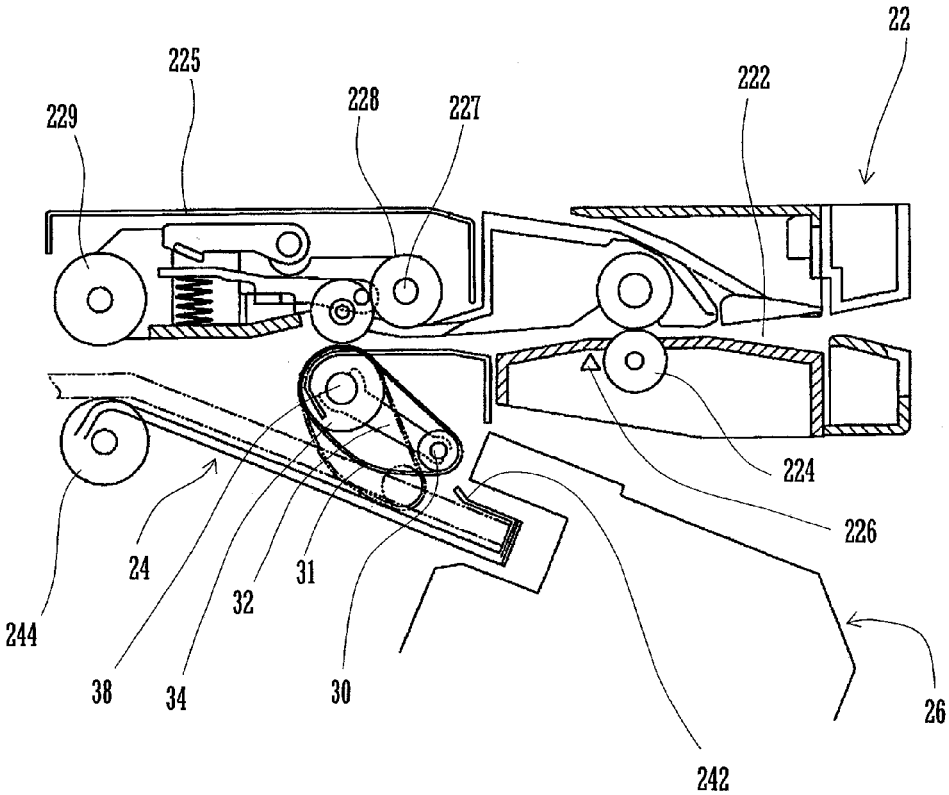
FIG. 5 is a view illustrating the structures of an introductory feed section, processing tray, post-processing section and catch tray.

FIG. 5 is a view illustrating the structures of the introductory feed section 22, processing tray 24, post-processing section 26 and catch tray 28. The introductory feed section 22 defines an introductory feed path 222 for feeding a sheet fed from the image forming section 14 in a horizontal direction. A pair of feed rollers 224 and a pair of feed rollers 34 are disposed along the introductory feed path 222. A sheet sensor 226 configured to detect the leading and trailing edges of a sheet being fed is disposed on the introductory feed path 222 at a location downstream of the feed rollers 224. The feed rollers 34 are configured to deliver a sheet to be post-processed after its passage through the introductory feed path 22 to the processing tray 24.

An upper sheet feeding roller 229 and a lower sheet feeding roller 244 are disposed on the introductory feed path 222 at a location downstream of the feed rollers 34. The upper sheet feeding roller 229 is rotatably supported at an end of a sheet delivery mechanism 225 supported for pivotal movement about a roller shaft 227 of a driving roller 228.

The lower feed roller 34 is joined to a support arm 32 which is pivotally movable about a rotating shaft 38 of the feed roller 34. The support arm 34 has a tip supporting a pulley 30 for rotation. A caterpillar belt 31 is supported by the support arm 32 and the pulley 30. The caterpillar belt 31 guides a sheet on the processing tray 24 toward a registration position in which the sheet registered with first and second registration plates 245 and 246 to be described later is to be placed. Specifically, the caterpillar belt 31 is designed to transmit feeding force to a sheet introduced into the processing tray 24 until an end of the sheet comes into contact with a positioning member 242. The positioning member 242 is arranged to come into abutment with the end portion of the sheet at the registration position.

The processing tray 24 is arranged to incline upward in the delivery direction. The sheet delivered to the processing tray 24 is guided toward the lower end of the processing tray 24 by its own weight and the driving force of the caterpillar belt 31. The way of sheet feeding on the processing tray 24 is not limited to this manner of sheet feeding. It is possible to guide the sheet to the registration position by cooperation between the caterpillar belt 31 and a feed roller additionally provided.

Figure 6:
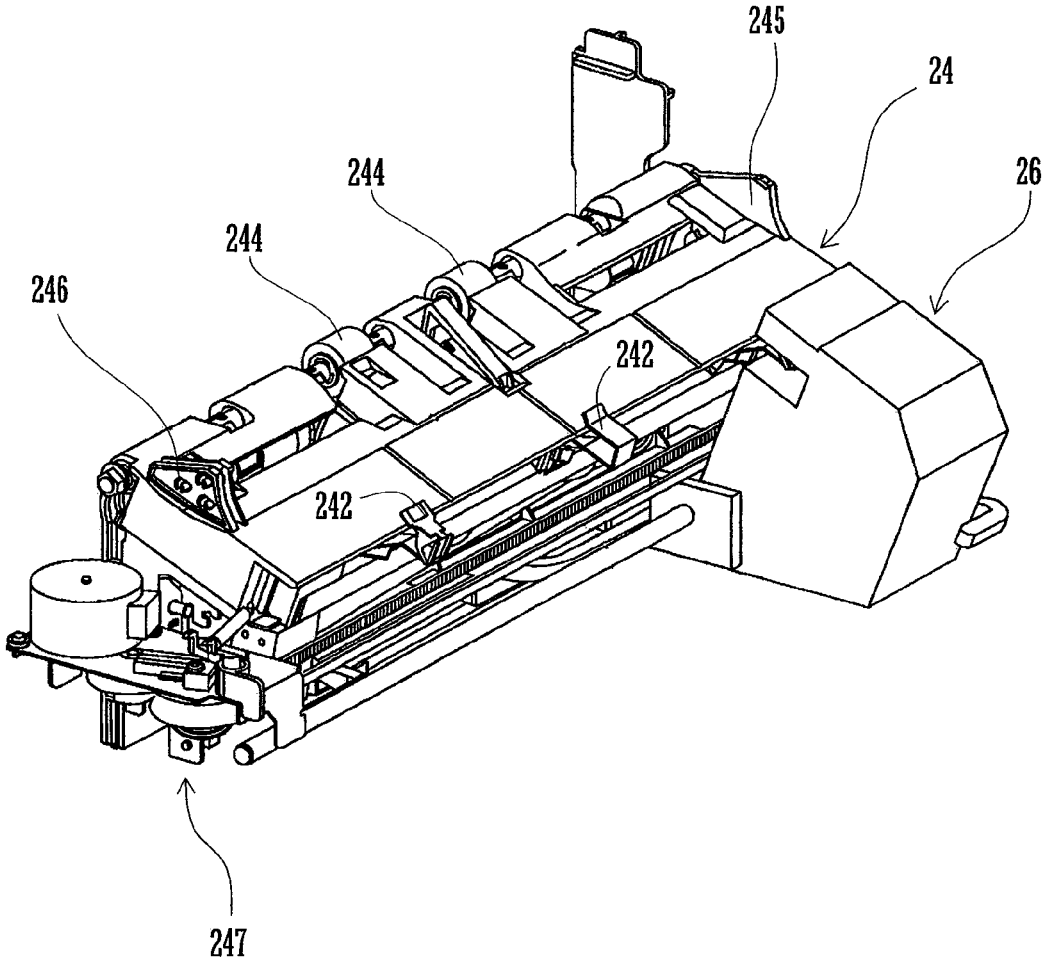
FIG. 6 is a view illustrating the structure of the processing tray.

FIG. 6 is a view illustrating the structure of the processing tray 24. The processing tray 24 is provided with the first and second registration plates 245 and 246 supported for movement in the widthwise direction of the processing tray 24. The first and second registration plates 245 and 246 are configured to move in the widthwise direction of the processing tray 24 by a first driving section 247 having a rack-and-pinion mechanism provided internally of the processing tray 24 and a motor for supplying driving force to the pinion gear. However, the technique of driving the first and second registration plates 245 and 246 is not limited to the technique of the present embodiment. While the post-processing section 27 of the present embodiment shown is movable in the widthwise direction of the processing tray 24 like the first and second registration plates 245 and 246, the feature that the post-processing section 26 is movable in the widthwise direction of the processing tray 24 is not indispensable but optional in carrying out the present invention.

Figure 7:
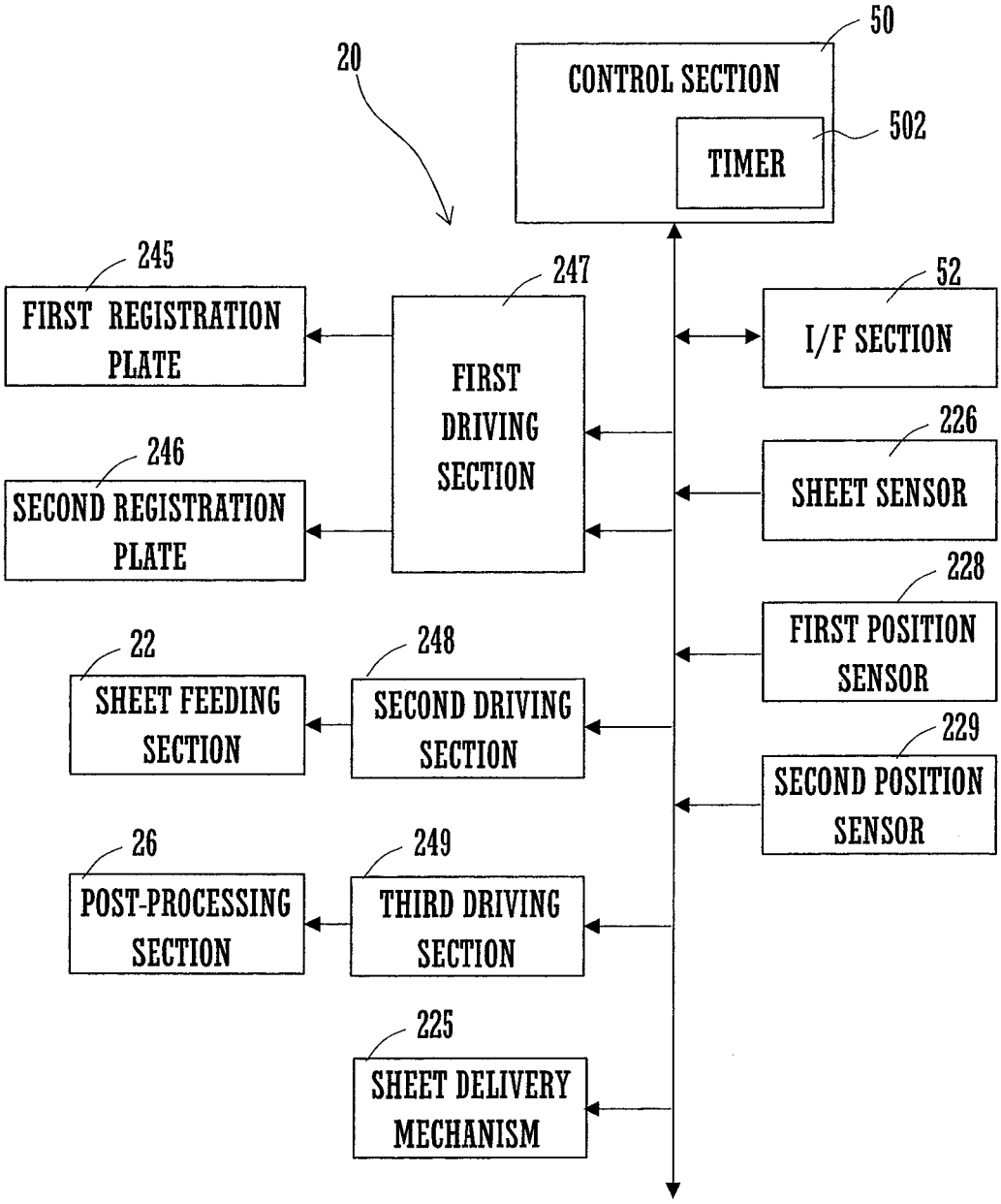
FIG. 7 is a block diagram schematically illustrating the configuration of a post-processing device.

FIG. 7 is a block diagram schematically illustrating the configuration of the post-processing device 20. As shown in FIG. 7, the post-processing device 20 includes a control section 50 to which are connected an I/F section 52, sheet sensor 226, first position sensor 228, second position sensor 230, first driving section 247, second driving section 248 and third driving section 249.

The I/F section 52 is configured to receive various signals from a main control section (not shown) of the image forming apparatus 100. For example, the I/F section 52 receives inputs of a signal indicative of the size of a sheet to be fed, a signal indicative of the type of post-processing to be performed by the post-processing device 20, a signal instructing to start post-processing, a signal indicative of completion of image formation on a sheet, and a like signal.

The first position sensor 228 is configured to detect the positions of the first and second registration plates 245 and 246. The second position sensor 229 is configured to detect the position of the post-processing section 26. The second driving section 248 is configured to supply driving force to the introductory feed section 22. The third driving section 249 is configured to supply driving force to the post-processing section 26.

Figure 8:
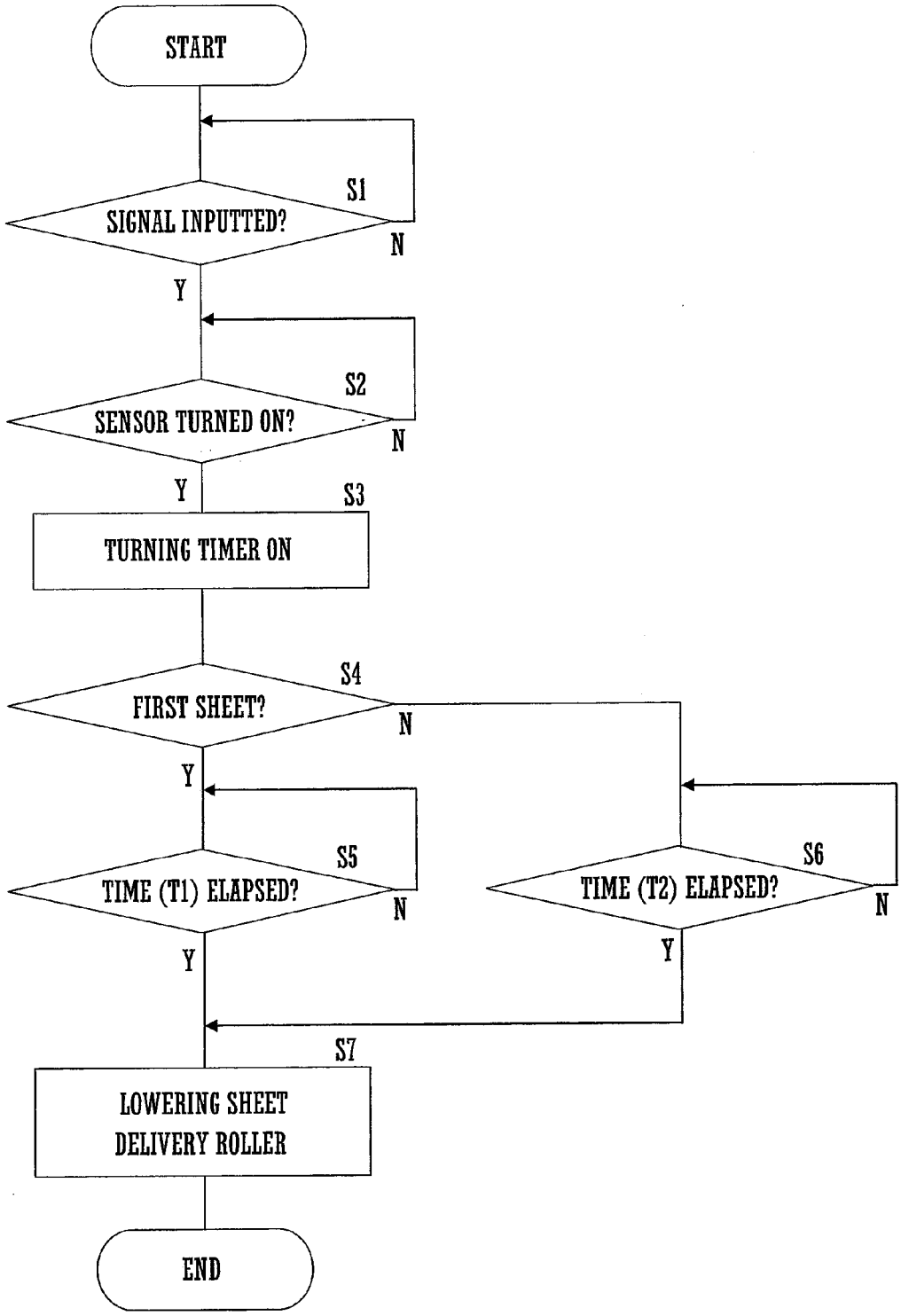
FIG. 8 is a flowchart illustrating an exemplary process performed by the post-processing device.

FIG. 8 is a flowchart illustrating an exemplary process carried out by the control section 50 of the post-processing device 20. The control section 50 waits for an input of a signal from the main control section of the image forming apparatus 100 (step S1).

In response to the input of the signal from the main control section of the image forming apparatus 100, the control section 226 waits for the sheet sensor 226 to detect the leading edge of a sheet (step S2). Upon detection of the leading edge of the sheet by the sheet sensor 226 in the waiting step S2, the control section 50 actuates a built-in timer 502 to start clocking (step S3).

Subsequently, the control section 50 determines whether or not the sheet being fed currently is the first sheet of a group of sheets to be post-processed at a time (step S4). The reason why such determination in step S4 is conducted is to change the contents of the sheet feeding control between the first sheet of the group of sheets to be post-processed at a time and the succeeding sheets that follow the first sheet.

If it is determined in the determination step S4 that the sheet being fed currently is the first sheet of the group of sheets to be post-processed at a time, the control section 50 waits until the timer 502 completes clocking of time T1 set (step S5). The time T1 is a time set shorter than the time required for the leading edge of a sheet being fed at a predetermined feeding speed to reach the catch tray 28 after having passed the sheet sensor 226. Preferably, the time T1 is the time required for the leading edge of the sheet to reach a point intermediate the catch tray 28 and the pair of upper and lower sheet feeding rollers 229 and 244 after having passed the sheet sensor 226.

Upon the completion of clocking of the time T1 by the timer 502 in the waiting step S5, the control section 50 controls the sheet delivery mechanism 225 to cause the upper sheet feeding roller 229 to be lowered to a contact position at which the upper sheet feeding roller 229 is brought into contact with the lower sheet feeding roller 244 (step S7).

On the other hand, if it is determined in the determination step S4 that the sheet being fed currently is the second sheet or any succeeding sheet of the group of sheets to be post-processed at a time, the control section 50 waits until the timer 502 completes clocking of time T2 set (step S6). The time T2 is a value which is larger than the time T1 and which is substantially equal to the value employed in the conventional post-processing device.

Upon the completion of clocking of the time T2 by the timer 502 in the waiting step S6, the control section 50 controls the sheet delivery mechanism 225 to cause the upper sheet feeding roller 229 to be lowered to the contact position at which the upper sheet feeding roller 229 is brought into contact with the lower sheet feeding roller 244 (step S7). The reason why the timing with which the upper sheet feeding roller 229 is lowered is delayed for the second sheet or any succeeding sheet of the group of sheets to be post-processed at a time is to make the time period of rubbing between the first sheet and the second sheet as short as possible, thereby to prevent the image formed on the second sheet from being contaminated or stained.

Figure 9A:
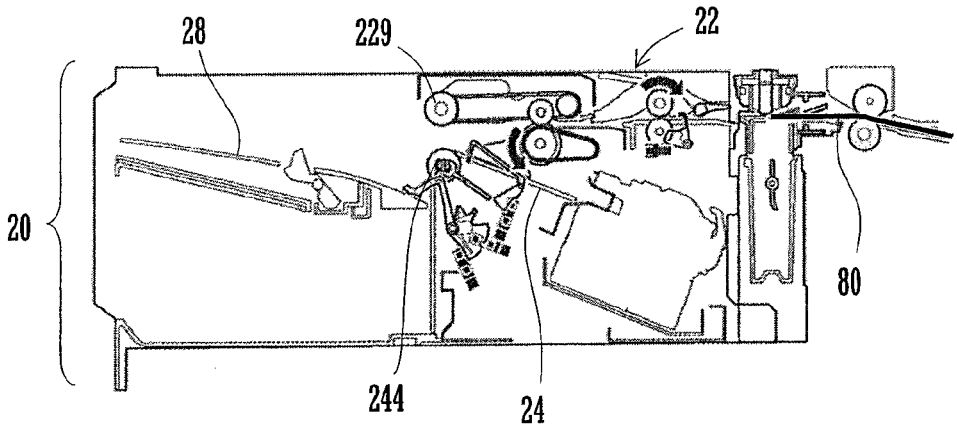
FIGS. 9A to 9C are views illustrating an exemplary sheet feeding procedure in a post-processing device according to an embodiment of the present invention.
Figure 9B:
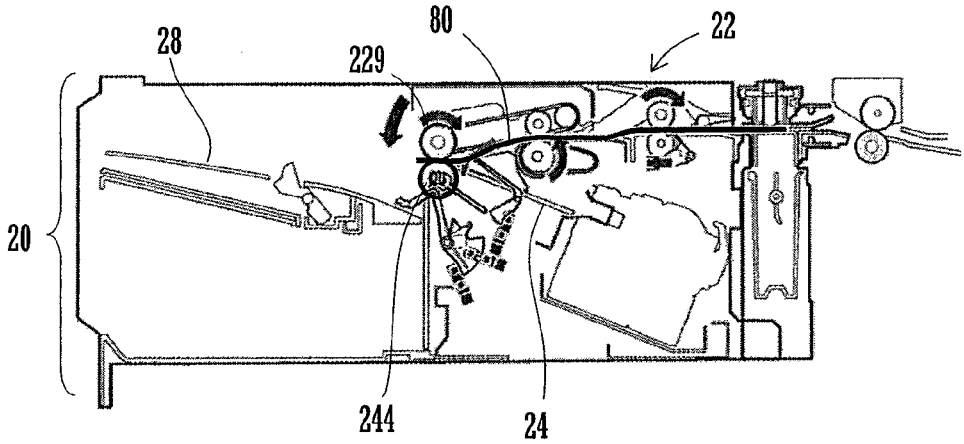
Figure 9C:
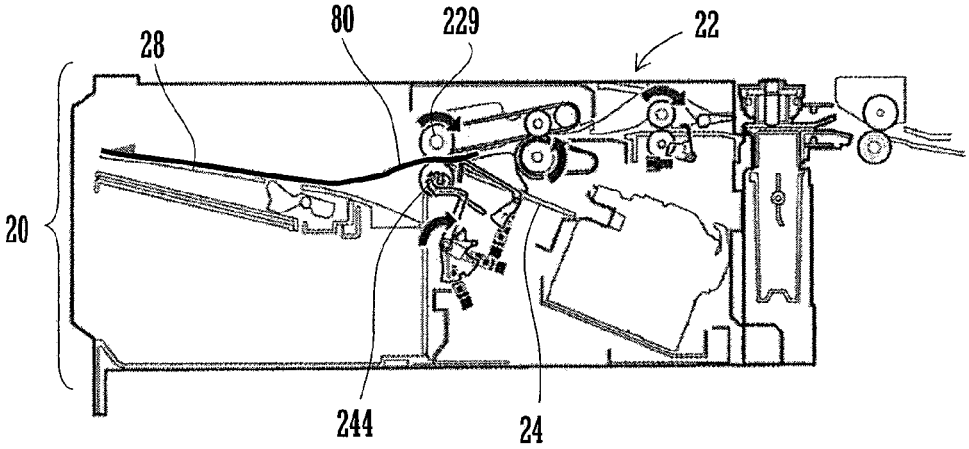

With the above-described construction, the first sheet 80 is held between the upper sheet feeding roller 229 and the lower sheet feeding roller 244 before its collision with the catch tray 28, as shown in FIGS. 9A and 9B. Therefore, the leading edge side of the sheet 80 becomes stabilized and stiffened by the support between the upper and lower sheet feeding rollers 229 and 244, with the result that the sheet 80 is made hard to curl down. For this reason, the sheet 80 can be easily guided to the catch tray 28 at a gentle angle, as shown in FIG. 9C. As a result, it is possible to prevent malfunctions including a failure to feed the sheet 80 and a failure to properly draw the sheet 80 into the processing tray 24 due to the sheet 80 rolled or curled by strong collision of its leading edge with the catch tray 28.

Figure 10A:
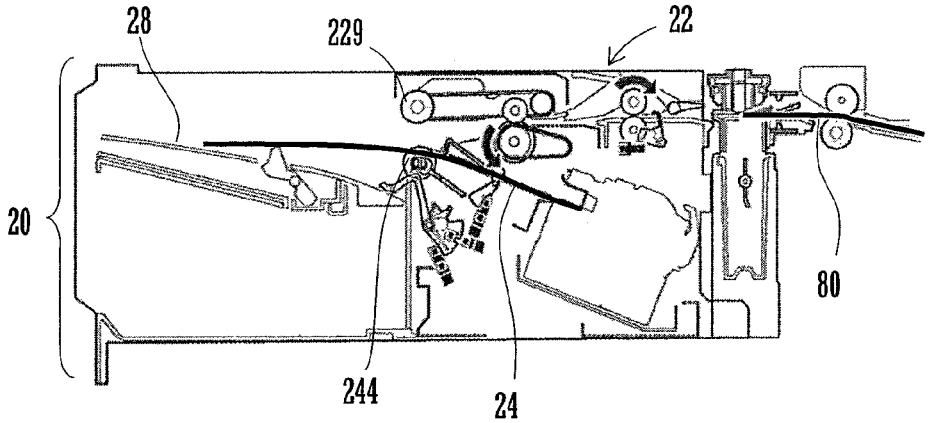
FIGS. 10A to 10C are views illustrating an exemplary sheet feeding procedure in a post-processing device according to an embodiment of the present invention.
Figure 10B:
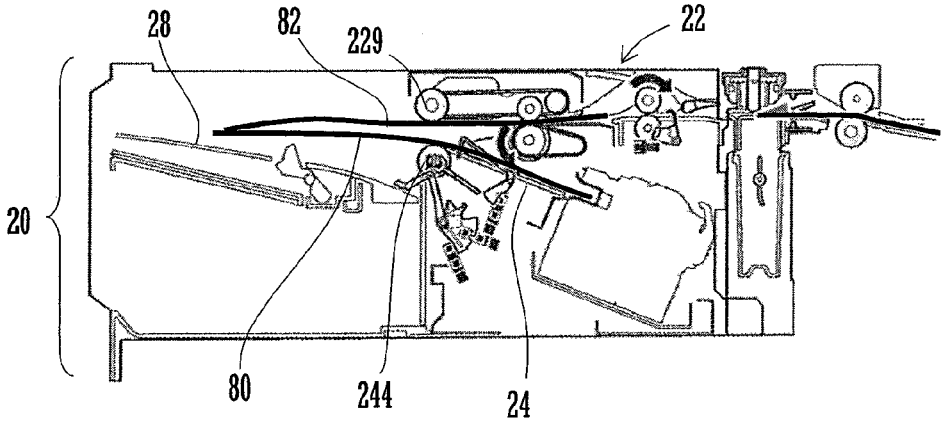
Figure 10C:
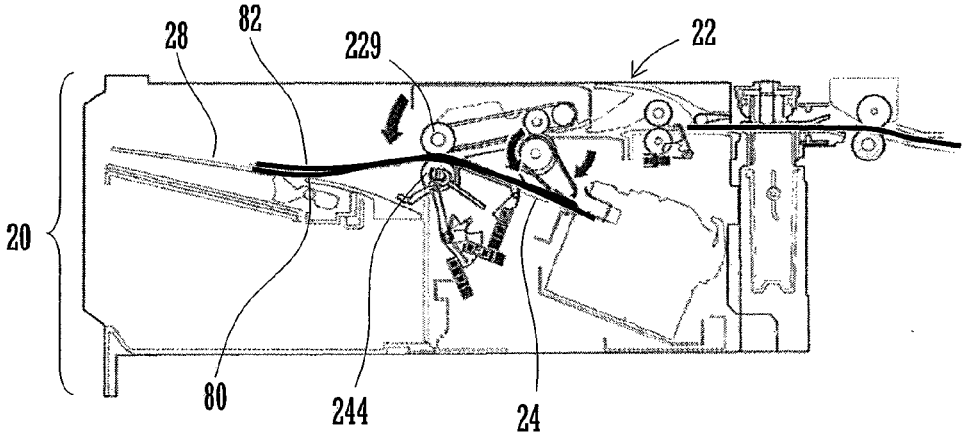

As shown in FIGS. 10A to 10C, with respect to the second sheet 82 and the succeeding sheets that follow the second sheet 82, the upper sheet feeding roller 229 is pressed against the lower sheet feeding roller 244 after the trailing edge of the sheet 82 has reached the space between the upper sheet feeding roller 229 and the lower sheet feeding roller 244, as in the conventional art. In this case, since the first sheet 80 is positioned between the second sheet 82 and the catch tray 28, the sheet 82 can be prevented from colliding with the catch tray 28 with its leading edge hung down, as shown in FIG. 10B.

Though the above-described embodiment utilizes the upper and lower sheet feeding rollers 229 and 244 which are similar to the conventional ones, it is preferable to provide a contrivance to allow the leading edge of the sheet 80 to be upwardly oriented easily when the sheet 80 is held between the upper sheet feeding roller 229 and the lower sheet feeding roller 244, as shown in FIGS. 11A, 11B, 12A and 12B. This is because the leading edge of the sheet 80 becomes less likely to catch on the catch tray 28 as the leading edge is oriented more upwardly.

Figure 11A:
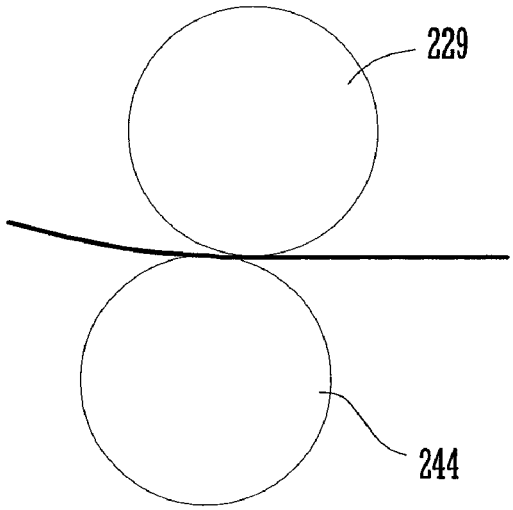
FIGS. 11A and 11B are views each illustrating another exemplary arrangement of a sheet delivery section.

FIG. 11A illustrates an arrangement wherein the upper sheet feeding roller 229 is disposed in a deviated position in which the upper sheet feeding roller 229 is located farther from the catch tray 28 than the lower sheet feeding roller 244. In order to realize this arrangement, the support arm supporting the upper sheet feeding roller 229 is simply shortened slightly.

Figure 11B:
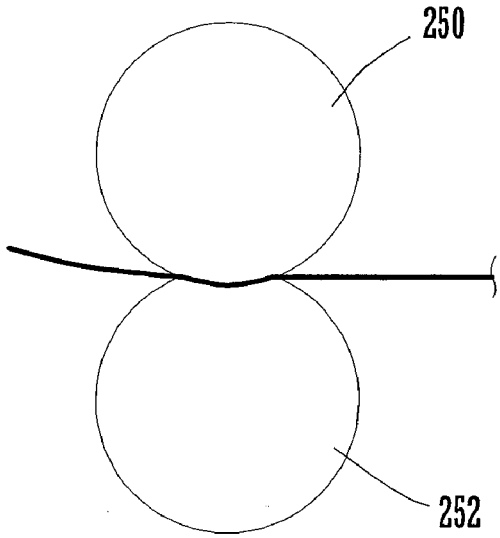

FIG. 11B illustrates an arrangement wherein the upper and lower sheet feeding rollers 229 and 244 are replaced with upper and lower sheet feeding rollers 250 and 252. The upper and lower sheet feeding rollers 250 and 252 are formed from respective of different materials. The material used for the lower sheet feeding roller 252 is softer than that used for the upper sheet feeding roller 250.

Figure 12A:
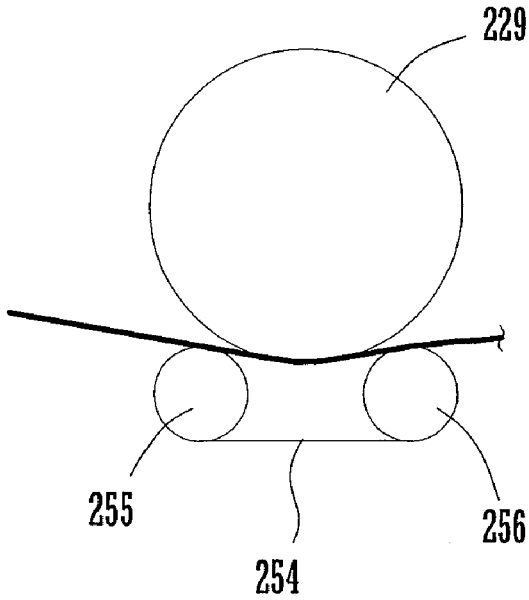
FIGS. 12A and 12B are views each illustrating another exemplary arrangement of the sheet delivery section.

FIG. 12A illustrates an arrangement wherein the lower sheet feeding roller 244 is replaced with an endless belt 254 which is supported by rollers 255 and 256 so as to allow its outer peripheral surface to press against the upper sheet feeding roller 229.

Figure 12B:
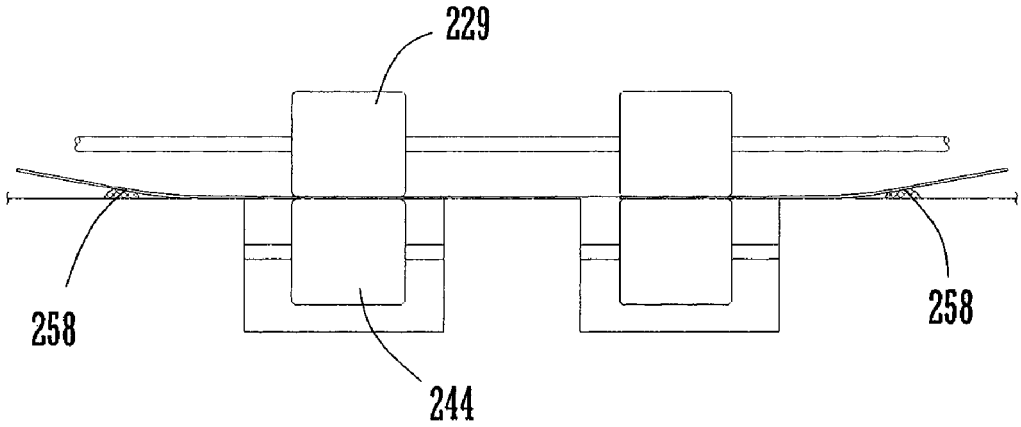

FIG. 12B illustrates an arrangement wherein projections 258 are formed on opposite sides of the upper and lower sheet feeding rollers 229 and 244 in the widthwise direction orthogonal to the sheet delivery direction. The projections 258 function to raise the widthwise opposite ends of the sheet 80 held between the upper sheet feeding roller 229 and the lower sheet feeding roller 244 from below. Since the projections 258 act to impart the sheet 80 with certain stiffness, the leading edge of the sheet 80 becomes less likely to be hung down and hence can be easily guided to the catch tray 28 at a gentle angle.

Each of the projections 258 preferably comprises an elastic member which can be depressed by the force exerted thereon from the sheet 80 when the sheet 80 has sufficient stiffness. This is because, when the sheet 80 is thick or when a plurality of sheets 80 are held between the upper sheet feeding roller 229 and the lower sheet feeding roller 244 at a time, the projections 258 fail to forcibly impart the sheet 80 with stiffness. Forcibly imparting the sheet 80 with stiffness might result in an inconvenience that the nipping force of the upper and lower sheet feeding rollers 229 and 244 is weakened. However, the arrangement described above does not allow such an inconvenience to occur.

While description has been made of the embodiment in which the post-processing device according to the present invention is applied to the image forming apparatus, the sheet processing apparatus to which the post-processing device according to the present invention is applicable is not limited to such an image forming apparatus.

The foregoing embodiments are illustrative in all points and should not be construed to limit the present invention. The scope of the present invention is defined not by the foregoing embodiment but by the following claims. Further, the scope of the present invention is intended to include all modifications within the scopes of the claims and within the meanings and scopes of equivalents.

What is claimed is:

1. A post-processing device for use with a sheet processing apparatus configured to perform predetermined processing on a sheet, the post-processing device being configured to perform post-processing on the sheet having been subjected to the predetermined processing at a sheet processing section of the sheet processing apparatus, the post-processing device comprising:

an introductory feed path configured to allow the sheet having been subjected to the predetermined processing at the sheet processing section to be introduced therein;

a processing tray disposed below the introductory feed path and configured to place thereon the sheet having passed through the introductory feed path;

a post-processing section configured to perform post-processing on the sheet placed on the processing tray;

a catch tray disposed below the processing tray and configured to receive the sheet delivered from the processing tray after the post-processing by the post-processing section;

a sheet delivery section having an upper rotary member and a lower rotary member which are disposed at an end of the processing tray lying on a catch tray side so as to be movable toward and away from each other, the sheet delivery section being configured to draw a sheet into the processing tray by the upper rotary member and the lower rotary member pressing against each other and rotating in a state where the members hold the sheet directed to the catch tray; and a control section configured to control at least operation of the sheet delivery section, wherein the control section shifts the upper rotary member and the lower rotary member from in a separate state to in a press-contact state at latest by the time a leading edge of a first sheet of a group of sheets to be post-processed at a time is brought into contact with the catch tray, and shifts the upper rotary member and the lower rotary member from in a separate state to in a press-contact state after a trailing edge of a succeeding sheet reaches a space between the upper rotary member and the lower rotary member.

2. The post-processing device according to claim 1, wherein the upper rotary member is an upper sheet feeding roller, while the lower rotary member is a lower sheet feeding roller, the upper sheet feeding roller being disposed in a deviated position in which the upper sheet feeding roller is located farther from the catch tray than the lower sheet feeding roller.

3. The post-processing device according to claim 1, wherein the upper rotary member is an upper sheet feeding roller, while the lower rotary member is a lower sheet feeding roller formed from a softer material than the upper sheet feeding roller.

4. The post-processing device according to claim 1, wherein the upper rotary member is an upper sheet feeding roller, while the lower rotary member is an endless belt which is supported by a plurality of rollers so as to allow an outer peripheral surface thereof to press against the upper sheet feeding roller.

5. The post-processing device according to claim 1, wherein: the upper rotary member is an upper sheet feeding roller, while the lower rotary member is a lower sheet feeding roller; and projections each comprising an elastic member are provided which are opposed to each other across the upper and lower sheet feeding rollers in a widthwise direction orthogonal to a sheet delivery direction so as to raise widthwise ends of the sheet held between the upper rotary member and the lower sheet feeding roller.

6. An image forming apparatus comprising a post-processing device as recited in claim 1.

7. An image forming apparatus comprising a post-processing device as recited in claim 2.

8. An image forming apparatus comprising a post-processing device as recited in claim 3.

9. An image forming apparatus comprising a post-processing device as recited in claim 4.

10. An image forming apparatus comprising a post-processing device as recited in claim 5.

* * * * *